US005464081A

United States Patent [19]

Zwanzig

[11] Patent Number: 5,464,081

[45] Date of Patent: Nov. 7, 1995

[54] CONCEALED TYPE RETRACTABLE SUITCASE HANDLE

[76] Inventor: Joy T. Zwanzig, 415, E. 37 St., Apt. 37K, New York, N.Y. 10016

[21] Appl. No.: 268,540

[22] Filed: Jul. 6, 1994

[51] Int. Cl.[6] ..... A45C 13/26

[52] U.S. Cl. ..... 190/115; 190/39; 16/112; 16/115

[58] Field of Search ..... 190/18 A, 115, 190/117, 39; 16/115, 112

[56] References Cited

U.S. PATENT DOCUMENTS

| | | | |
|---|---|---|---|
| 939,332 | 11/1909 | Schehr | 16/112 |
| 2,510,754 | 6/1950 | Norlin | 19/18 A X |
| 3,522,955 | 8/1970 | Warner, Jr. | 16/115 X |
| 3,799,568 | 3/1974 | Hager | 16/115 X |
| 4,358,005 | 11/1982 | Fontana | 16/115 X |
| 4,616,379 | 10/1986 | Lio | 190/117 X |
| 4,838,396 | 6/1989 | Krenzel | 190/18 A |
| 5,048,649 | 9/1991 | Carpenter et al. | 190/115 X |
| 5,116,289 | 5/1992 | Pond et al. | 190/115 X |
| 5,323,887 | 6/1994 | Scicluna et al. | 190/115 X |

*Primary Examiner*—Sue A. Weaver
*Attorney, Agent, or Firm*—Bacon & Thomas

[57] ABSTRACT

A concealed retractable U-shaped handle for a suitcase which can be retained at any desired angle to facilitate pushing and lifting the suitcase after the handle is fully extended. The handle includes socket seats and balls for adjustment of the pushing and lifting angle. Each of the adjacent ends of the handle is slidably retained to a ball in the socket seat by a washer and bolt so that the handle may be freely adjusted for the desired pulling and lifting angle by the free rotation of the balls in the socket seats. A pair of toothed slots are disposed between two side walls of an L-shaped slot formed on each socket seat for securing the handle in position when it is not manually held. A backing plate, two channel elements and a cover form a guide raft assembly at a selected side of the suitcase for free reciprocation of the retractable handle.

5 Claims, 6 Drawing Sheets

CONCEALED TYPE RETRACTABLE SUITCASE HANDLE

BACKGROUND OF THE INVENTION (a) Field of the Invention

The invention relates to a handle for a suitcase or similar luggage piece, and particularly a structure of a concealed type retractable suitcase handle which can be freely retracted and retained at any desired angle to facilitate pulling and lifting the suitcase.

(b) Description of the Prior Art

Conventionally each suitcase or similar luggage piece has a handle on the top of its front side and an auxiliary handle, known as a side handle, at a side thereof to facilitate pulling of the suitcase. Normally, a foldable short handle is hinged or fixed to a side of the suitcase to become an auxiliary handle by pulling out the handle when its use is required.

SUMMARY OF THE INVENTION

The main objective of the present invention is to provide a concealed type retractable handle for suitcases or similar luggage, and particularly a handle incorporated with socket seats and balls for adjustment of the pushing/lifting angle of the handle and toothed slots disposed between two side walls of two L-shpaed slots, each slot being formed on a socket seat to retain the handle so that the handle can maintain its desired angular position when it is not held manually.

Another objective of the present invention is to provide a concealed type retractable handle for a luggage piece with a backing plate, channel elements and cover to form a guide rail at a selected side of the luggage piece for free reciprocation of the retractable handle.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
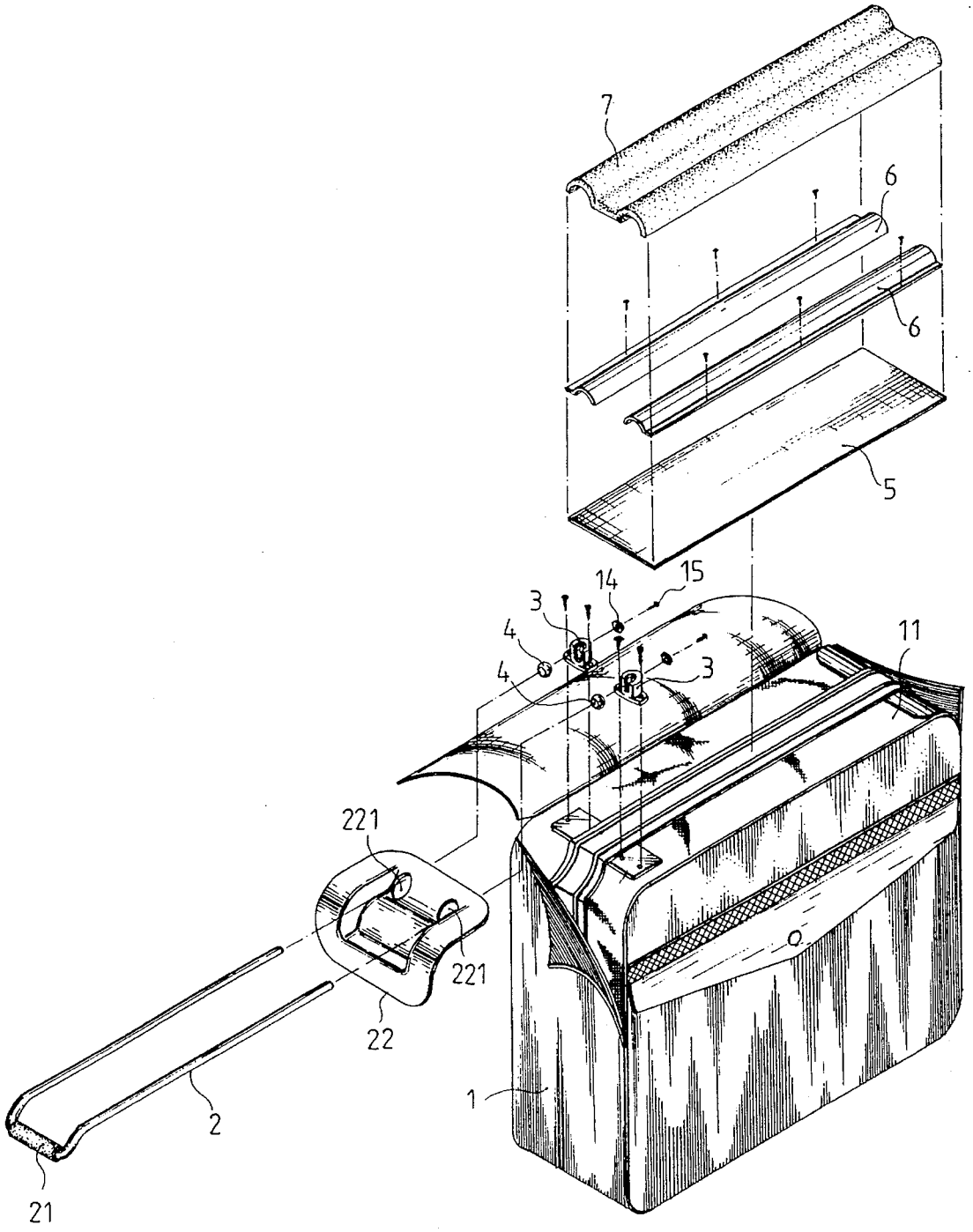
FIG. 1 is a perspective exploded view of the present invention assembled on a luggage.
Figure 2:
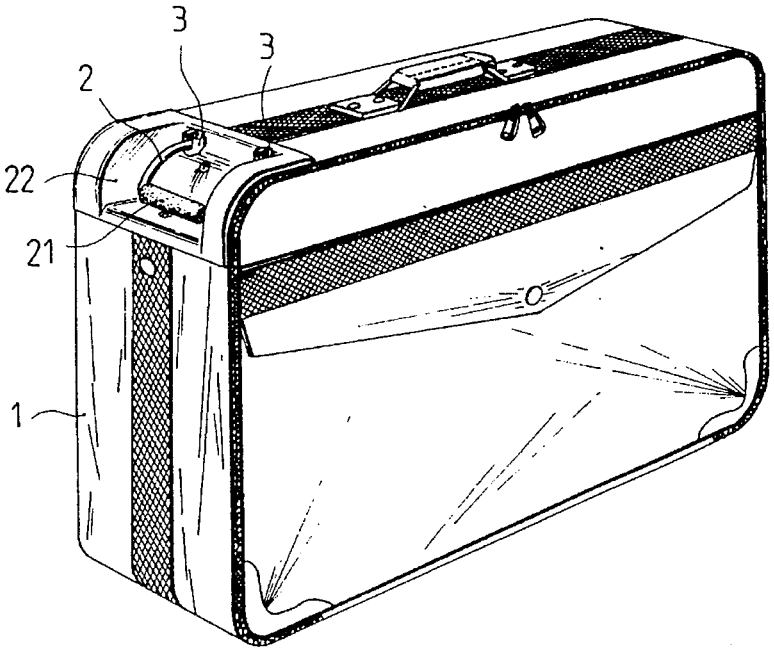
FIG. 2 is a perspective view of the present invention assembled on a luggage.

As shown in FIGS. 1 and 2, the present invention is a U-shaped retractable handle 2 attached to a side of a suitcase or similar luggage piece 1 in a manner so that it can be extended and retracted freely and each of its two adjacent ends is incorporated within a socket seat 3 and a ball 4 to form a mechanism which permits pulling and hanging of the suitcase 1.

Figure 4:
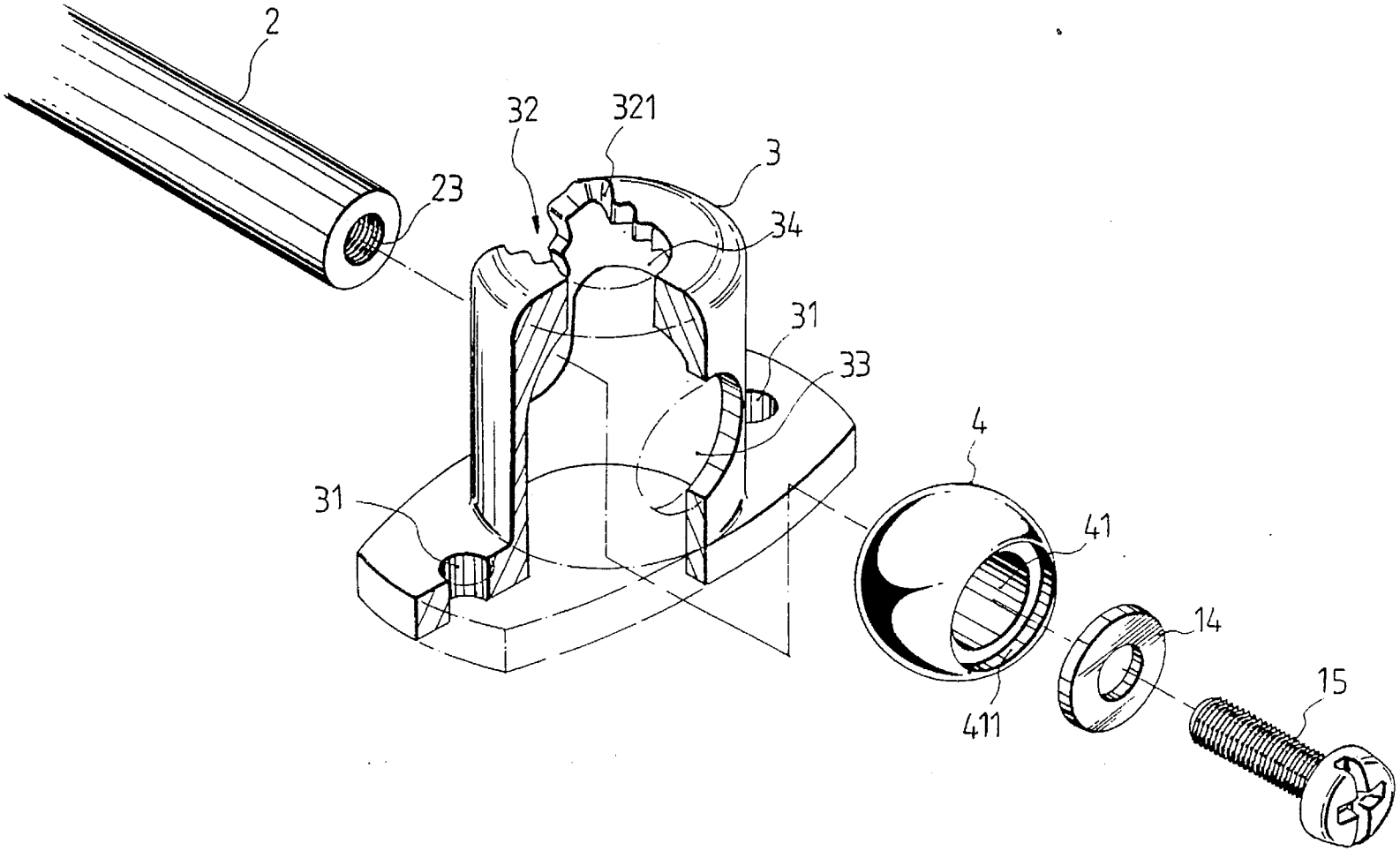
FIG. 4 shows the socket seat in partial section with an exploded view of the handle end, ball and washer assembly.

The retractable handle 2 is of an elongate U-shaped configuration with an outer grip 21. It is extended into a side 11 of the suitcase 1 through a handle seat 22 fixed on an edge of the suitcase 1. As shown in FIG. 4, each end of the retractable handle 2 is formed with a threaded lock hole 23.

Figure 3:
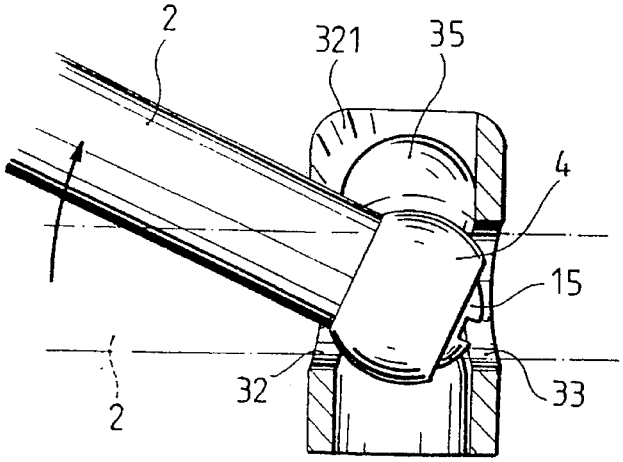
FIG. 3 is a sectional view of the socket seat with the handle seated in the ball.

Two socket seats 3 are placed parallel on the suitcase 1, each on a lateral side thereof. The socket seat 3, as shown in FIGS. 3 and 4, is a cap-like seat structure with a fixing hole 31 on each lateral side of its cap wing portion for fixing to the side 11 of suitcase 1. A lateral side of the seat 3 is formed with an L-shaped slot 32 and an opposite side hole 33. The L-shaped slot 32 extends upwardly from a side of seat 3 to an upper hole 34 to form an L-shaped channel. Within the socket seat 3 there is a ball socket for positioning of a ball 4. As shown in FIG. 3, a stepped opening 35 is provided at the upper side of the ball socket. Moreover, the said slots 32 each include an appropriate toothed slot 321 between the side walls thereof with a gap slightly smaller than the diameter of the rod body of the retractable handle 2 in order to secure each rod body firmly in a desired angular position through the packing effect applied by the toothed slot 321.

Figure 5:
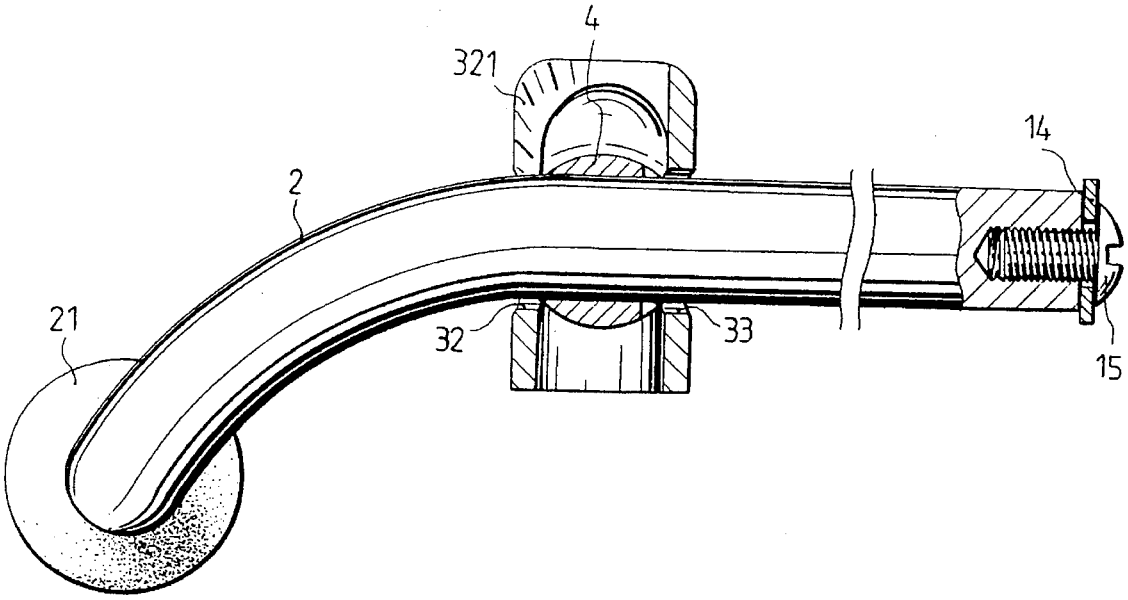
FIG. 5 is a partial-sectional view of the handle, and the ball and socket seat in section.

The ball 4 is located within the ball socket in the socket seat 3. It has a central hole 41 having a large stepped opening 411 on one end. The central hole 41 is designed for slidably receiving the rod body of the handle 2 therethrough. A washer 14 is fully inserted to the stepped opening 411 and a bolt 15 is inserted through the washer 14 to lock the retractable handle by engagement with the threaded lock hole 23 at an end of each rod body of the retractable handle 2, as shown in FIG. 5.

Figure 8:
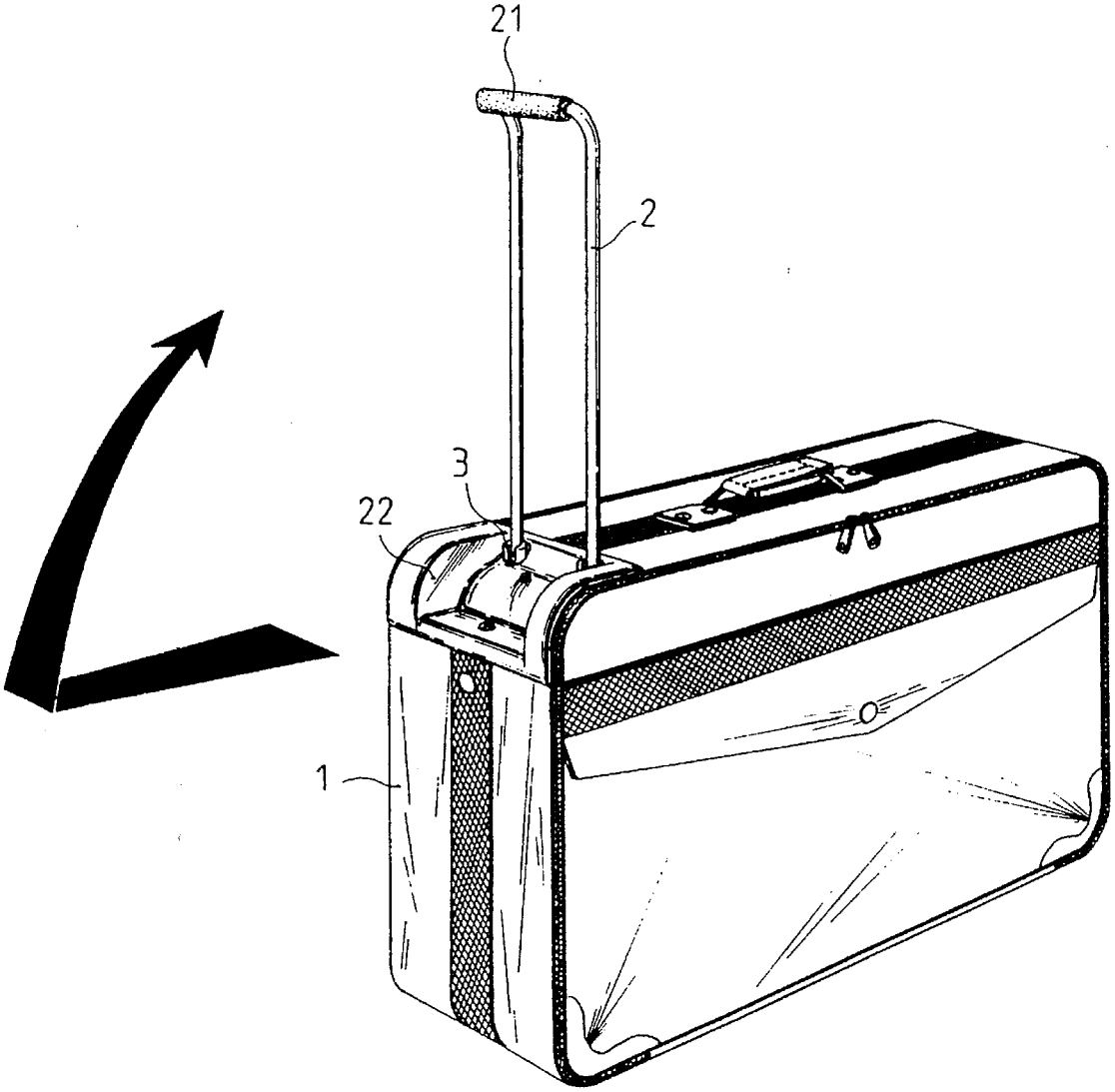
FIG. 8 is a perspective view illustrating the use of the retractable handle according to the present invention.

With the above described assembly, the retractable handle 2 can be retained in its fully extended position by seizing the ball 4 in the ball socket of the socket seat 3. Because the ball socket is designed with a stepped opening 35 above it, the retractable handle 2 may be movably pivoted so that it can be lifted up from its horizontal position to any angle up to a vertical position as shown in FIG. 8. Moreover, as there is a toothed slot 321 formed between the side walls of the slots 32, the retractable handle 2 can be retained a desired angular position by the seizing effect from the gap of the toothed slots 321 between the slots. Thus, retractable handle 2 will not fall down when it is not manually held. Therefore, during use the retractable handle 2 will not fall down and its use is very convenient since it can be repositioned easily.

Figure 6:
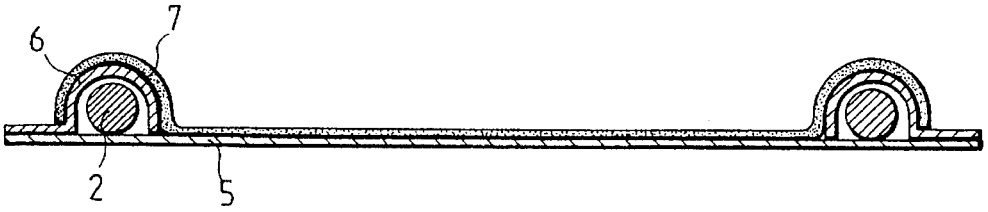
FIG. 6 is a cross-sectional view of a guide rail fixed at a side of the luggage with the present invention.
Figure 7:
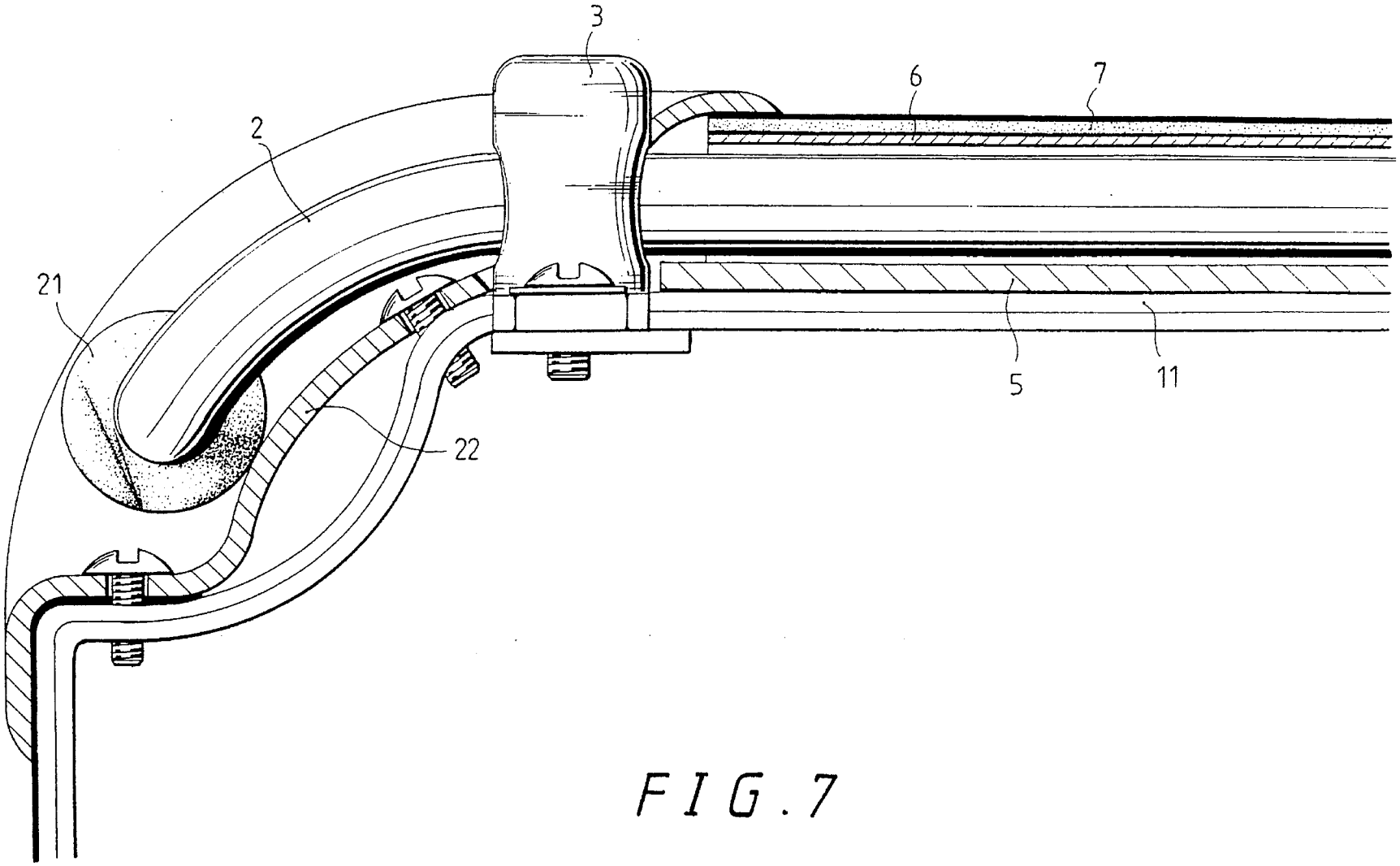
FIG. 7 is a cross-sectional view of the present invention with the guide rail shown in FIG. 6.

Since the said retractable handle 2 is a U-shaped rod structure, a backing plate 5, two channel elements 6 and a cover 7 are placed at a selected position on the side 11 of suitcase 1 to form a set of guide mils for the retractable handle 2 as shown in FIGS. 6 and 7.

The backing plate 5 is a plate fixed on the surface of side 11, preferably on a hard surface of side 11 of suitcase 1 for maintaing the retractable handle 2.

Each of the channel elements 6 is a long channel structure secured to the said backing plate 5. These two channel elements 6 are laid in parallel to receive the retractable handle in a manner so that the retractable handle can be freely reciprocated within the channel elements 6 without any possibility of disengagement from the guide rails so formed.

The cover 7 is formed with two curved portions corresponding to the respective positions of the channel elements 6, and it together with an end portion of the handle seat 22 and a covering layer of the suitcase 1, is designed to conceal the channel elements 6.

With the backing plate 5, the two channel elements 6 and the cover 7 fixed to a side of the suitcase 1, the present invention provides a nice and simple guide rail assembly which permits free extension and retraction of the retractable handle 2.

The said handle seat 22 is in the form of a concave shell-like configuration with two holes 221 received through which the retractable handle 2 is received. The grip 21 of the retractable handle 2 is slightly bent so as to maintain close contact with the concave handle seat 22. Therefore, the retractable handle 2 is maintained flush with the corner of the suitcase 1 after it is pushed into its full retraction position. Upon using of the handle 2, it can be pulled out and adjusted to any angle up to a vertical position to ease pushing or lifting suitcase 1, as shown in FIG. 8. With the toothed slot 321 between the slots 32 of each seat 3, the retractable handle 2 can be retained in an angular position and is prevented from falling downwardly when it is not held manually.

What is claimed is:

1. A concealed type retractable handle for a suitcase comprising:

a) an elongate U-shaped handle having a pair of rod bodies terminating in a pair of adjacent ends;

b) means defining a housing on the suitcase for receiving the pair of rod bodies when the handle is in a retracted position;

c) a pair of socket seats adjacent the housing means, each socket seat being of a cap configuration and including wing portion means having at least one hole therein for securing the seat to a side of a suitcase, an L-shaped slot extending along a lateral side and upper side of the seat and terminating in an upper hole, and a side hole on a lateral side opposite the slot, the slot and hole being dimensioned to slidably receive the rod body;

d) each socket seat further defining an internal ball socket in communication with the L-shape slot and side hole and a stepped opening at an upper side of the ball socket defining said upper hole, a ball disposed within each ball socket, each ball including a central hole therethrough being dimensioned for slidably receiving one of said rod bodies of the handle and means carried by each end of the rod bodies for retaining the handle to the balls when the handle is in a fully extended position; and e) whereby when the handle is in its fully extended position, the retaining means engage the balls and the balls rotate in the socket seats with the rod bodies extending through the L-shaped slots, thereby permitting the handle to be pivoted vertically to a desired angle along the L-shaped slots for pulling or lifting the suitcase.

2. The handle assembly of claim 1 wherein the retaining means includes:

the central hole of each ball having a stepped opening at one end therefor;

b) each end of each rod body including a threaded lock hole formed therein;

c) a pair of washers and a pair of thread fasteners; and d) each washer being secured to an end of a rod body through engagement of a threaded fastener within each threaded lock hole so that when the handle is in its fully extended position, each washer is disposed in engagement with the stepped opening of each central hole.

3. The handle assembly of claim 1 wherein each L-shaped slot further includes a plurality of toothed edges defining said slot formed therein, said toothed edges defining a gap that is smaller than the diameter of the rod body for permitting the retractable handle to be secured in a desired angular position of adjustment.

4. The handle assembly of claim 1 wherein said housing means includes:

a) a backing plate for attachment to a surface on a side of the suitcase;

b) a pair of channel members secured to the backing plate in parallel disposition and dimensioned for slidably receiving the rod bodies of the handle therein as the handle is extended or retracted; and c) a cover enclosing the channel elements.

5. The handle assembly of claim 1 further including:

a) means forming a handle seat for attachment to the suitcase, the handle seat means having a concave portion and two holes formed therein and disposed adjacent to and aligned with the L-shaped slob of the socket seats;

b) the rod bodies of the handle being slidably received through the two holes; and c) the handle including a bent grip portion disposable in flush engagement within the concave portion of the seat when the handle is in its fully retracted position.

* * * * *